United States Patent [19]

Creedon

[11] Patent Number: 4,681,016

[45] Date of Patent: Jul. 21, 1987

[54] RAIL GUN BARREL WITH GAS CONTAINMENT MEANS

[75] Inventor: Richard L. Creedon, San Diego, Calif.

[73] Assignee: GA Technologies Inc., San Diego, Calif.

[21] Appl. No.: 606,209

[22] Filed: May 2, 1984

[51] Int. Cl.[4] ..... F41F 1/02

[52] U.S. Cl. ..... 89/8; 124/3; 310/12

[58] Field of Search ..... 89/8, 7, 14.1, 16, 15, 89/14.05, 14.5, 33.03; 42/76 R, 76 A, 75 R; 124/3; 310/10–14; 318/135; 285/373, 419; 277/192, 12, 32

[56] References Cited

U.S. PATENT DOCUMENTS

| | | | |
|---|---|---|---|
| 1,628,896 | 5/1927 | Medearis | 42/76 R |
| 2,420,492 | 5/1947 | Marseilles | 89/14.05 |
| 2,801,416 | 8/1957 | Evans et al. | 89/14.05 |
| 2,899,984 | 8/1959 | Gaffin | 285/373 X |
| 3,130,575 | 4/1964 | Rogers | 89/14.05 |
| 3,380,344 | 4/1968 | Bucklisch et al. | 89/14.5 X |
| 3,611,867 | 10/1971 | Silsby | 89/14.05 |
| 3,727,513 | 4/1973 | Wicks | 89/14.05 X |
| 3,763,739 | 10/1973 | Tassie | 89/7 |
| 3,808,943 | 5/1974 | Kelly | 42/76 R |
| 4,050,700 | 9/1977 | Lifferth | 285/373 X |
| 4,126,077 | 11/1978 | Quesnel | 89/14.05 |
| 4,376,406 | 3/1983 | Black | 89/7 |
| 4,424,734 | 1/1984 | Janssen et al. | 89/16 |

OTHER PUBLICATIONS

DTIC Technical Report AFATL-TR-81-99, "Study of an Electromagnetic Gun System for Air Defense", by I. R. McNab et al, Nov. 1981.

*Primary Examiner*—Deborah L. Kyle
*Assistant Examiner*—John E. Griffiths
*Attorney, Agent, or Firm*—Fitch, Even, Tabin & Flannery

[57] ABSTRACT

A rail gun barrel includes gas containment means for limiting the penetration of high pressure gas into interfaces between rails and insulating members. The preferred gas containment means comprises one or more channels formed in one or more of the interfaces. In one embodiment of the invention, the channels simply provide space for expansion of gas. In another embodiment, the channels are partially or totally filled with seal material which prevents gas from escaping radially outward beyond the channels.

3 Claims, 3 Drawing Figures

RAIL GUN BARREL WITH GAS CONTAINMENT MEANS

BACKGROUND OF THE INVENTION

The present invention relates to a barrel assembly for an electromagnetic rail gun.

A typical rail gun includes an elongated barrel which has a pair of longitudinally extending parallel conductors or rails disposed symmetrically about its axis. The rails are connected at their rearward, or breech, ends to opposite terminals of a source of direct current. A circuit through the rails may be completed either by a conductor disposed between the rails or by a plasma arc between the rails. This results in the flow of current which generates magnetic flux between the rails. The flux cooperates with the current in the conductor or the plasma arc to accelerate the conductor or plasma forward between the rails. The projectile may include the conductor or may be positioned forward of the conductor or plasma arc and driven forward thereby.

The electromagnetic forces generated during firing of the rail gun tend to drive the rails apart in addition to accelerating the projectile. Also tending to drive the rails apart is gas pressure generated in the barrel during firing. The gas pressure may be particularly high in barrels of rail guns wherein a plasma arc completes the circuit between the rails, due to the vaporization of metal during the initiation of the arc. A more detailed explanation of the initiation of the plasma arc is given in co-pending, commonly assigned U.S. patent application Ser. No. 540,808, which is incorporated herein by reference.

Due to the magnitude of the gas pressure in the barrel during and immediately after firing, it is difficult to prevent gas from entering the interfaces between the insulators and rails. One problem which may result from high pressure gas entering the interfaces is that the forces tending to drive the rails and insulators apart may become excessive due to the increase in the effective surface area on the rails and insulators which is exposed to the high pressure gas. Accordingly, there is a need for means to limit the magnitude of bursting forces which may result from penetration of high-pressure gas into the interfaces.

SUMMARY OF THE INVENTION

In accordance with the present invention, there is provided a rail gun barrel having gas containment means for limiting the penetration of high pressure gas into the interfaces between the rails and insulating members. The preferred gas containment means comprises one or more channels formed in one or more of the interfaces between the rails and insulators. In one embodiment of the invention, the channels simply provide space for expansion of gas. As high pressure gas flows into one of the channels and expands, its pressure decreases and it is prevented from penetrating into the portion of the interface which is radially outward of the channel. In another embodiment of the invention, the channels are partially or totally filled with seal material which prevents gas from escaping radially outward beyond the channels.

Accordingly, it is a general object of the present invention to provide a rail gun barrel having means to limit bursting forces on the barrel component due to high pressure gas within the barrel.

It is a further object of the present invention to provide a rail gun barrel having gas containment means for limiting the passage of gas radially outward through the interfaces between the rails and insulators.

Further objects and features of the present invention are disclosed in the following description and accompanying illustrations.

DETAILED DESCRIPTION OF THE PREFERRED EMBODIMENT

Figure 1:
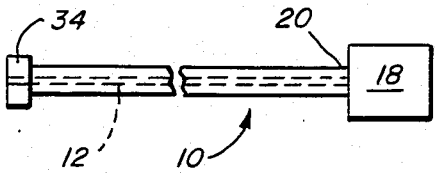
FIG. 1 is a side elevational view of a rail gun barrel in accordance with one embodiment of the present invention.

The present invention is embodied in a rail gun barrel 10 defining an elongated bore 12 for passage of a projectile (not shown). The barrel 10 comprises a pair of elongated, generally parallel, electrically conductive rails 14 and a pair of elongated, generally parallel insulating members 16 disposed circumferentially between the rails 14. The rails 14 are disposed symmetrically about the longitudinal axis of the barrel, as are the insulating members 16.

The rails 14 are typically made of a metal such as a copper alloy having good electrical conductivity, and are electrically connected at their respective rearward or breech ends 20 to opposite terminals of a source of direct current. Means 18 for loading projectiles into the barrel are provided at the breech end. In the illustrated embodiment, the bore 12 through which the projectile travels has a generally circular cross section. The bore could alternatively be of rectangular or other suitable cross section.

During operation, an electrical potential of relatively high voltage is established between the breech ends of the respective rails 14. Current flows from one rail to the other to complete an electrical circuit, generally passing between the rails through a plasma arc. The electromagnetic forces thereby generated advance the arc through the bore to propel the projectile in advance thereof.

The arc is typically initiated by passage of high current through a strip of metal. The current vaporizes the metal strip, producing plasma, i.e., ionized gas particles. This results in a pressure pulse which may drive air or other gas within the barrel 10 into the interfaces 22 between the rails 14 and insulators 16, urging the rails and insulators apart.

Entry of gas into the interfaces 22 occurs at faults or blemishes on the facing surfaces **14*a* and 16*a* of the rails 14 and insulators 16**. If sufficient gas enters to open a narrow gap along substantial length of an interface, the exposure of a relatively large surface area to high pressure gas can lead to generation of destructive bursting forces.

In accordance with the present invention, there is provided a rail gun barrel having gas containment means 24 for limiting the passage of gas radially outward through the interfaces 22 between abutting side surfaces **14*a* and 16*a* of the rails 14 and insulators 16, respectively. Herein, the gas containment means comprises four elongated conduits or channels 24 extending parallel to the axis of the barrel, one formed in each interface 22**.

Figure 2:
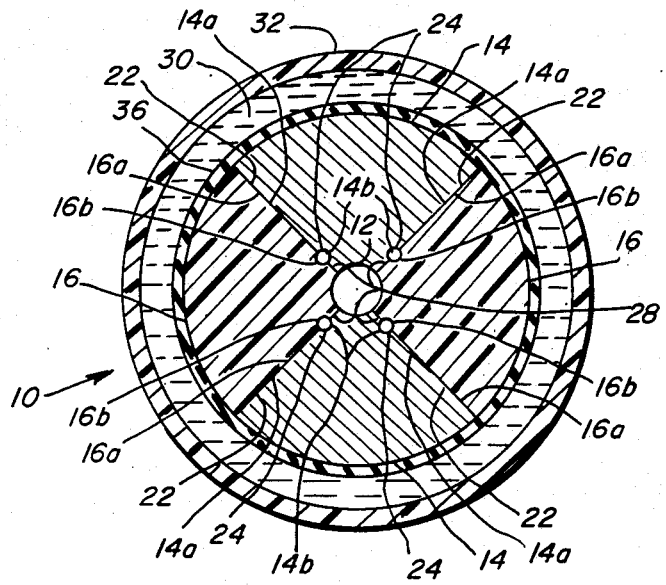
FIG. 2 is a transverse sectional view of the barrel of the rail gun of FIG. 1.

In one embodiment of the invention, illustrated in FIGS. 1 and 2, the channels 24 provide space for high pressure gas to expand, so that as gas traveling radially outward through the interfaces 22 reaches a channel 24, its pressure decreases beyond the level necessary for further penetration radially outward. The volume of any gas entering the channels 24 is relatively small, as it is the result of a pressure pulse of relatively short duration driving gas through an extremely narrow gap. The gas containment channels 24 preferably communicate with the atmosphere to facilitate exhausting of the gas from the channels.

Figure 3:
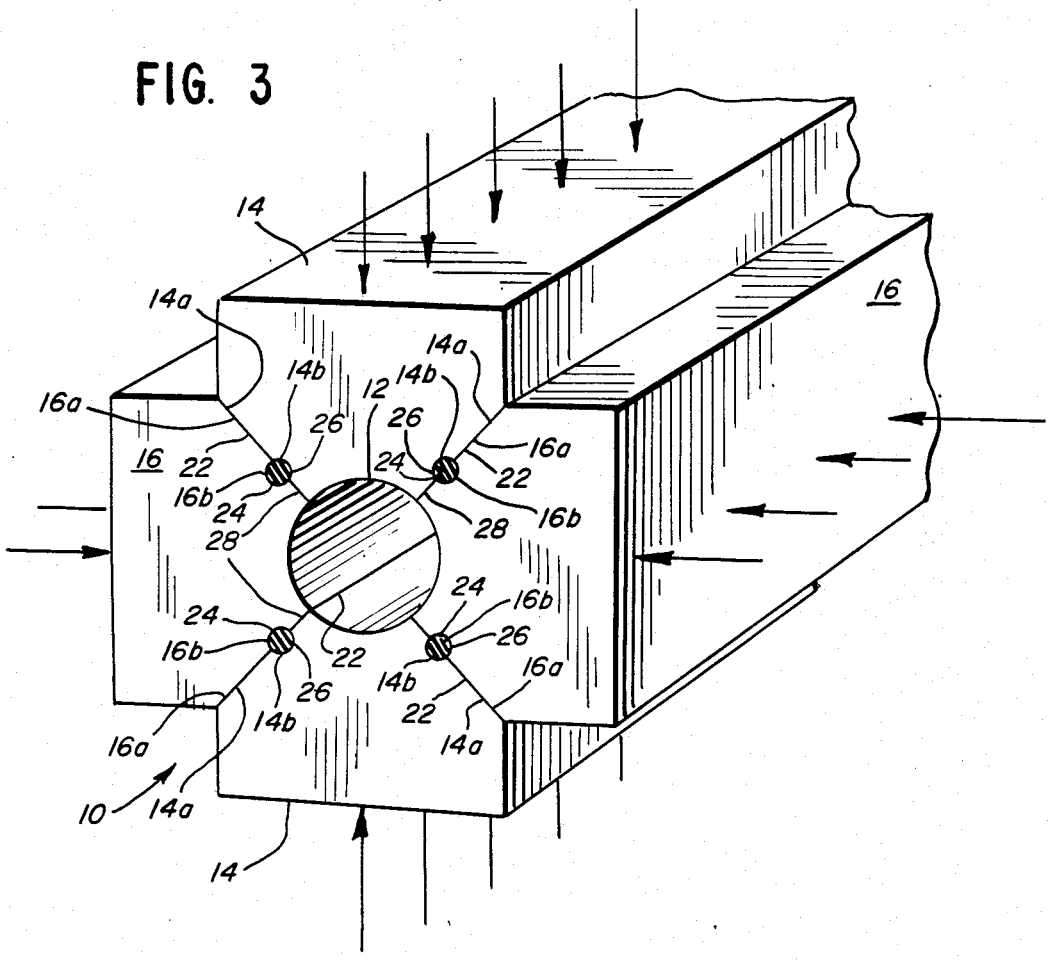
FIG. 3 is a schematic perspective view of a rail gun barrel in accordance with a second embodiment of the present invention.

In a second embodiment of the invention, illustrated schematically in FIG. 3, the channels 24 contain seal material 26 which blocks the progress of the high pressure gas. The seal material may be an elastomer which is capable of withstanding high temperatures.

In the illustrated embodiments, the channels 24 are formed by machining grooves **14*b* and 16*b* into the facing side surfaces 14*a* and 16*a* of the rails and insulating members 14 and 16, respectively. The illustrated grooves 14*b* and 16*b* cooperate to form generally cylindrical channels 24. It will be appreciated that the grooves could be of other shapes and that the channels could alternatively be formed by grooving only the side surfaces 14*a* of the rails, or by grooving only the side surfaces 16*a*** of the insulating members.

During firing of the rail gun, high pressure gas may exert bursting force on portions 28 of the interface surfaces radially inward of the gas containment channels 24, but will not act on portions radially outward thereof. The theoretical limit on the magnitude of the bursting force is thus dependent in part on the distance between the gas containment channels 24 and the bore 12. Accordingly, it is desirable that the channels 24 be located at relatively short distances from the bore 12 so as to minimize the interface area which may be subjected to high pressure gas. However, compressive stresses in the rails 14 and insulating members 16 may be higher near the bore 12, and this may require that the channels 24 be located at a minimum radius to avoid excessive distortion of the channels due to strain. Strain may be particularly significant in the insulating members 16 which are typically made of plastic which is generally not as strong as the metal from which the rails 14 are made.

Referring particularly to FIG. 2, the present invention may be embodied in a rail gun barrel 10 employing a pressure medium 30 as described in copending U.S. patent application Ser. No. 506,430, which is incorporated herein by reference. In this embodiment, the rails 14 and insulating members 16 are constrained against outward radial displacement and preloaded by a surrounding pressure medium 30. A lightweight, relatively rigid outer shell 32 having sealing means 34, at its ends contains the pressure medium 30. The pressure medium 30 applies approximately uniform radial compression forces to the peripheral surfaces of the rails 14 and insulating members 16. In the embodiment illustrated in FIG. 2, the pressure medium 30 is a fluid. In other embodiments, it might be an elastomer having relatively low shear strength or a resin which can be pressurized and subsequently cured prior to firing the gun.

A relatively flexible sleeve or membrane 36 fits over the rails 14 and insulating members 16 to prevent the pressure medium 30 from leaking into the interfaces 22 between the rails 14 and insulating members 16. Any suitable external pressurizing means may be employed to bring the pressure medium to the desired pressure.

It will be appreciated that the magnitude of bursting force, due to the pressure of gas in the interfaces, will be equal to the product of the respective magnitudes of the pressure of the gas and the area exposed thereto. The channels 24 reduce the area exposed thereto. The channels 24 reduce the area exposed by limiting the progress of the gas and reduce the pressure of gas by enabling expansion of the gas. Thus, in this embodiment, the channels 24 serve a dual function in preventing bursting forces from becoming excessive.

From the foregoing, it will be appreciated that the present invention provides a novel and improved rail gun barrel which includes gas containment means. While a preferred embodiment has been illustrated and described herein, there is no intent to limit the scope of the invention to this or any other particular embodiment. For example, the gas containment means of the present invention might also find application in rail gun barrels employing other means for constraining the rails, such as bolted clamps or filament windings. The scope of the invention is defined by the following claims.

What is claimed is:

1. A rail gun barrel assembly defining an elongated central bore for firing of a projectile, comprising:

structural containment means;

a pair of elongated rails supported by said structural containment means; and a pair of elongated insulators supported by said structural containment means:

said rails and insulators being cooperative to define an elongated central bore and being supported alternately about the circumference of the bore so that said rails do not contact one another;

each said rail having a pair of opposite side surfaces, and each said insulator having a pair of opposite side surfaces, each of said side surfaces of each of said insulators being in contact with a respective one of the side surfaces of a respective one of said rails to define an interface therebetween;

said rails and insulators defining means to limit radial penetration of gas into said interfaces comprising four elongated gas containment channels extending generally parallel to said elongated central bore and spaced therefrom, a respective one of said gas containment channels being located at each said interface, each said channel providing a predetermined volume to permit expansion of gas penetrating said interfaces so as to reduce the pressure of said gas and prevent it from penetrating said interfaces beyond said channels.

2. A rail gun barrel assembly in accordance with claim 1 wherein said structural containment means comprises an elongated tubular outer shell having an axis generally parallel to said elongated central bore, and a pressure medium located within said shell outwardly of said rails and insulating members so that pressurization of said pressure medium provides containment force directed radially inward against said rails and insulating members.

3. A rail gun barrel assembly in accordance with claim 2 wherein said pressure medium is a liquid, said assembly further comprising a liquid-impermeable sleeve extending between said pressure medium and said rails and insulating members.

* * * * *